United States Patent [19]

Mayer et al.

[11] 4,312,713

[45] Jan. 26, 1982

[54] COKE OVEN GAS EXTRACTION EQUIPMENT

[75] Inventors: Georg Mayer, Ratingen; Horst Schröter, Viersen; Helmut Laux, Meerbusch, all of Fed. Rep. of Germany

[73] Assignee: Hartung, Kuhn & Co. Maschinenfabrik GmbH, Fed. Rep. of Germany

[21] Appl. No.: 112,612

[22] Filed: Jan. 16, 1980

[51] Int. Cl.[3] ..... C10B 27/00; C10B 27/04

[52] U.S. Cl. ..... 202/263; 202/262

[58] Field of Search ..... 202/227, 263, 262; 98/115 VM; 266/158

[56] References Cited

U.S. PATENT DOCUMENTS

| | | | |
|---|---|---|---|
| 3,647,636 | 3/1972 | Helm | 202/263 |
| 3,676,305 | 7/1972 | Cremer | 202/263 |
| 3,715,282 | 2/1973 | Pries et al. | 202/263 |
| 3,981,778 | 9/1976 | Schulte et al. | 202/263 |
| 4,069,108 | 1/1978 | Riecker | 202/263 |
| 4,113,572 | 9/1978 | Manda et al. | 202/263 X |
| 4,123,333 | 10/1978 | Schulte et al. | 202/263 X |
| 4,247,370 | 1/1981 | Nijhawan et al. | 202/263 |

FOREIGN PATENT DOCUMENTS 2326630 5/1973 Fed. Rep. of Germany .

*Primary Examiner*—Frank W. Lutter
*Assistant Examiner*—Roger F. Phillips
*Attorney, Agent, or Firm*—Dressler, Goldsmith, Shore, Sutker & Milnamow, Ltd.

[57] ABSTRACT

An improved duct system is provided for collecting gases from the coke side of a battery of coke-oven chambers with vertical flues in which a coke guide is mounted for movement along the ovens on rails, in which the coke transport car is mounted for movement on rails along the ovens adjacent the coke guide, and in which a stationary main collection duct with a belt covered slot is provided adjacent the transport car rails. An extraction hood is provided for covering the transport car and connecting the discharge end of the coke guide with the transport car. The hood has an integral connecting line adapted to be connected between a gas collection duct above the coke guide and a gas transfer device movable on the main duct under the belt for directing the gases into the main duct. Also integral with the extraction hood are two gas outlet ducts, one on each side of the connecting line, separate from the connecting line, for connecting the extraction hood to the gas transfer device.

3 Claims, 15 Drawing Figures

COKE OVEN GAS EXTRACTION EQUIPMENT

FIELD OF THE INVENTION

The invention relates to equipment for collecting, extracting and purifying gases arising on the coke side of a battery of chamber coke-ovens with vertical flue. The equipment consists of a track which runs on the gas gallery along the oven chambers and on which a coke guide car can travel, the coke guide of which is adjustable on the car transversely to the direction of motion thereof in the longitudinal direction of the oven chambers. That equipment also includes a gas collection duct above the coke guide, a transport car which can travel along the oven chambers, an extraction hood which reaches over the loading zone of the transport car. The extraction hood can travel along the oven chambers and is, during pushing a fully carbonized coke cake, connected gas-tight to the gas collection duct. The equipment also includes a stationary gas extraction and purification device and a gas main duct which is arranged parallel to the coke-oven battery and is connected to the extraction and purification device. The gas main duct has a longitudinally extending opening which is covered by an elastic cover belt which can be lifted off the opening of the gas main duct. A gas transfer device is connected to the extraction hood and the gas collection duct. The gas transfer device is movable above the gas main duct and below the cover belt for the purpose of lifting the latter off the opening of the gas main duct so that the gas can be transferred from the gas collection duct and the extraction hood into the gas main duct.

DESCRIPTION OF THE PRIOR ART

U.S. Pat. No. 4,069,108 describes equipment for collecting, discharging and purifying foul gases arising on the coke side of a coke-oven battery, wherein the extraction hood is coupled to a gas transfer car which can travel on a main duct laid parallel to the coke-oven battery. In the operating state, the extraction hood is connected to a hood extending over the coke guide so that the foul gases rising from both the coke guide and a quench car into the extraction hood are extracted via a common line and the gas transfer car into the main duct. The gas transfer car can travel either by means of its own drive or with the aid of the undercarriage bearing the extraction hood. In this known equipment, trouble-free extraction of the foul gases, arising at the coke guide on pushing of the red-hot coke, through the extraction hood, as well as trouble-free sealing of the coke guide from the hood involve certain difficulties. Another disadvantage is the independent mobility of the gas transfer car on the gas main duct in relation to the desired trouble-free guiding of the gas transfer car, which guiding must be ensured in view of trouble-free lifting of the cover belt from the gas main duct by the belt-lifting device contained within the gas transfer car. Furthermore, to protect the belt covering the main duct, a protective device is provided in the main duct, which protective device prevents hot waste gases from coming into contact with the cover belt and permits passage of the hot foul gases only in the zone of the lifted-off belt.

SUMMARY OF THE INVENTION

The invention avoids the abovementioned difficulties and further difficulties by an arrangement wherein the extraction hood comprises, as integral components, (1) a connecting line between the gas collection duct, above the coke guide, and the gas transfer device, and (2) gas outlet ducts, separate from the connecting line, for transferring the foul gases, collected by the extraction hood, into the gas transfer device. The gas transfer device is rigidly built into the hood undercarriage and is joined rigidly and gas-tight to the connecting line and to the gas outlet ducts of the extraction hood, so that, in the operating position of the equipment, the foul gases collected above the coke guide can be transferred into the gas main duct separately from the foul gases which rise from the transport car into the extraction hood. The coke guide is at least partially surrounded by a sealing frame which is of telescopic design and can be moved parallel to the main axis of the coke guide by means of a drive mechanism.

The equipment according to the invention allows a very compact and light-weight construction with short extraction paths which entail only small pressure drops.

As a result of the arrangement of a separate connecting line, passed through the extraction hood, between the gas collection duct, above the coke guide, and the gas transfer device, a relatively high vacuum is applied to the gas collection duct above the coke guide, which vacuum is greater than that inside the extraction hood so that the foul gases arising above the coke guide can reliably be collected and extracted. Since, moreover, the gas transfer device is a fixed component of the extraction hood or of the undercarriage of the latter, a mobile arrangement of this gas transfer device on rails laid on the main duct is unnecessary. Thus the gas main duct can be of a simpler and cheaper design and better guiding of the cover belt is achieved. The gas extraction ducts and the connection line can be closed immediately by the shutters, if they are no longer required for the extraction of the foul gases, so that aspiration of inleaked air is avoided and power is saved.

A shutter is provided in the passage opening for red-hot coke in the side wall of the extraction hood that faces the coke guide. This shutter, as well as the shutters in the gas outlet ducts and in the conneting line, can be actuated to open when the sealing frame moves against the side wall of the extraction hood. In this way, the gas outlet ducts, the connecting line and, if appropriate, also the extraction hood can always be made ready for operation shortly before a red-hot coke cake is pushed out of an oven chamber.

It is also advantageous to provide gas coolers in the gas outlet ducts in the zone of the gas transfer device, which gas coolers are arranged in the gas transfer ducts downstream of the shutters in the direction of flow of the gases. This arrangement of the gas coolers makes it possible to cool the foul gases, flowing from the red-hot coke in the transport car into the extraction hood and, the gas transfer ducts thereof, to such an extent that the provision of a special protective device for the cover belt in the gas main duct is superfluous. The arrangement of gas coolers in the connecting line which connects the gas collection duct above the coke guide to the gas transfer device is, however, not necessary in most cases because the foul gases arising above the coke guide are cooler and have to flow through a longer distance up to the gas transfer device so that, at the latter, they have already been cooled to a temperature which is not deleterious to the cover belt.

Moreover, a mechanism can be provided, by means of which only the shutters for the connecting line and for the passage opening in the side wall of the extraction hood can automatically be moved into their closed position when the sealing frame moves back from the extraction hood. This ensures that, after a red-hot coke cake has been pushed out of an oven chamber, the connecting line and the extraction hood are automatically closed so that an aspiration of inleaked air and water vapor, which adversely affect the distillation process and exert a corrosive action on the duct walls, is avoided.

By contrast, the shutters for the two gas outlets ducts can be fixed in their position, in which they open the gas outlet ducts, by a locking device and can be released to close the gas outlet ducts only by a fixed control device. When the shutters are positioned to open the gas outlet ducts, cooling air apertures which are provided therein are closed. When the shutters are positioned to close the gas outlet ducts, the apertures are opened to enable cooling air to be supplied to the gas coolers. As a result of locking the shutters in the gas outlet ducts in the open position, the foul gases, rising from the red-hot coke in the transport car after operating an oven chamber, can thus also be collected and extracted through the gas main duct to the extraction and purification device.

In a further embodiment, the undercarriage of the extraction hood can be coupled to the transport car, by means of a coupling device fitted on the latter, in a position in which the extraction hood completely covers the box-like superstructure of the transport car. This makes it possible to move the transport car and the extraction hood in the coupled state up to a point shortly before the quench station and, only at that point, to separate the extraction hood from the transport car so that the latter can be moved into the quench station. At the same time, this ensures that the free atmosphere is kept completely clean from the foul gases which, during the movement of the transport car, rise from the red-hot coke present thereon.

Only when the stationary control device, preferably provided in the zone of the quench station, is reached does the control device actuate the locking device so that the shutters close the gas outlet ducts and open towards the cooling air aperture for supplying cooling air to the gas coolers.

Further details of the invention and the advantages associated therewith will be explained in the following text by reference to diagrammatic drawings of illustrative embodiments of the invention, in which.

Figure 1:
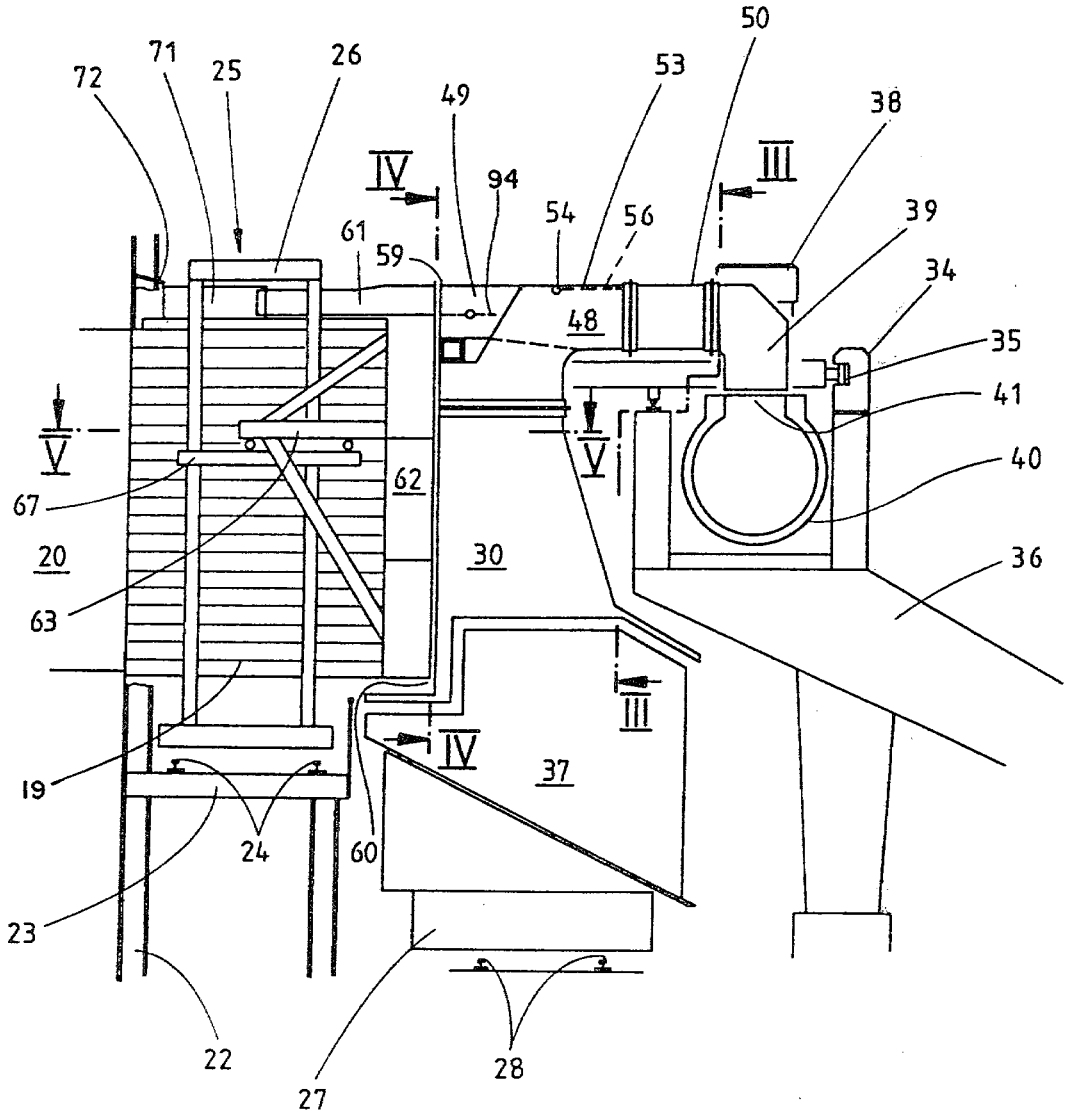
FIG. 1 shows a view of the equipment according to the invention.
Figure 8:
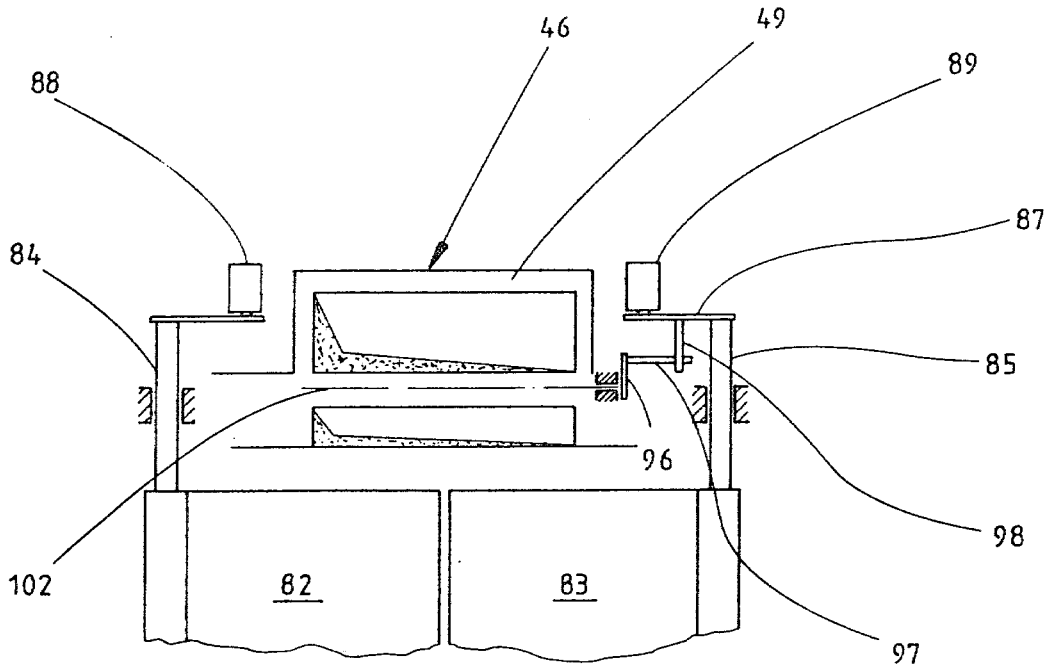
Figure 9:
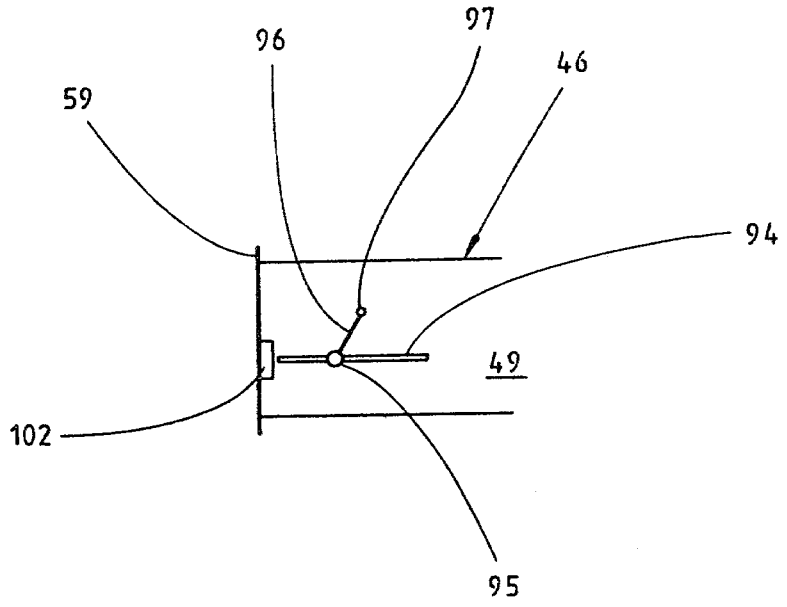
Figure 10:
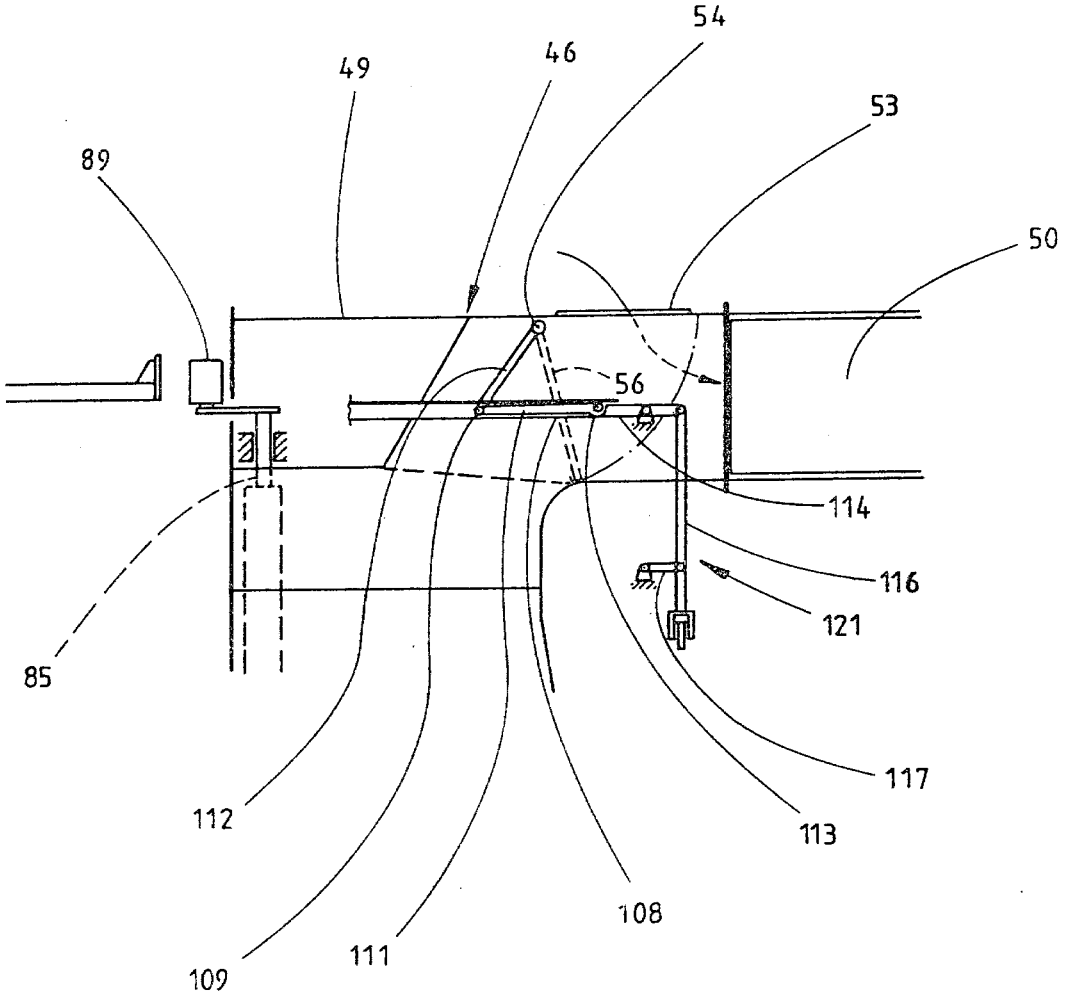
Figure 11:
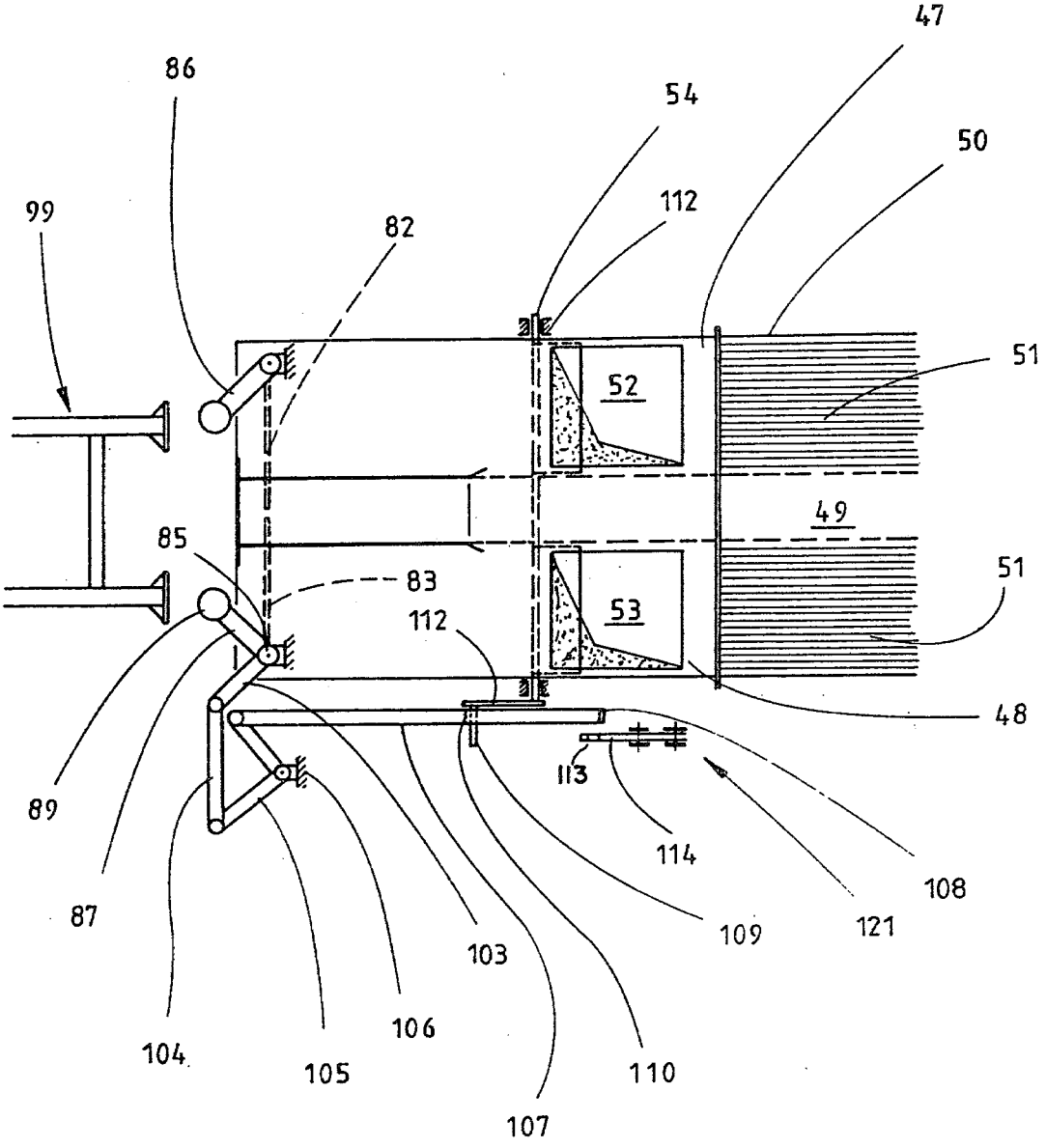
Figure 12:
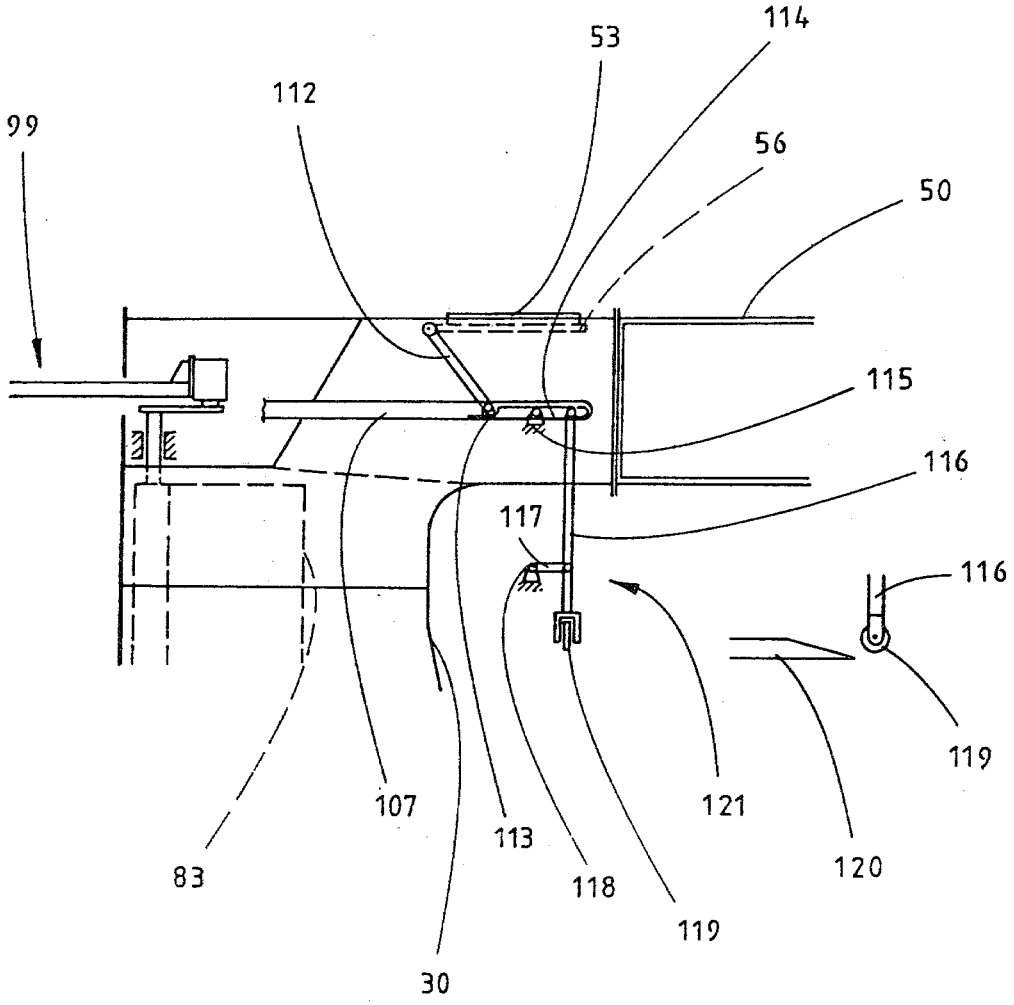
Figure 13:
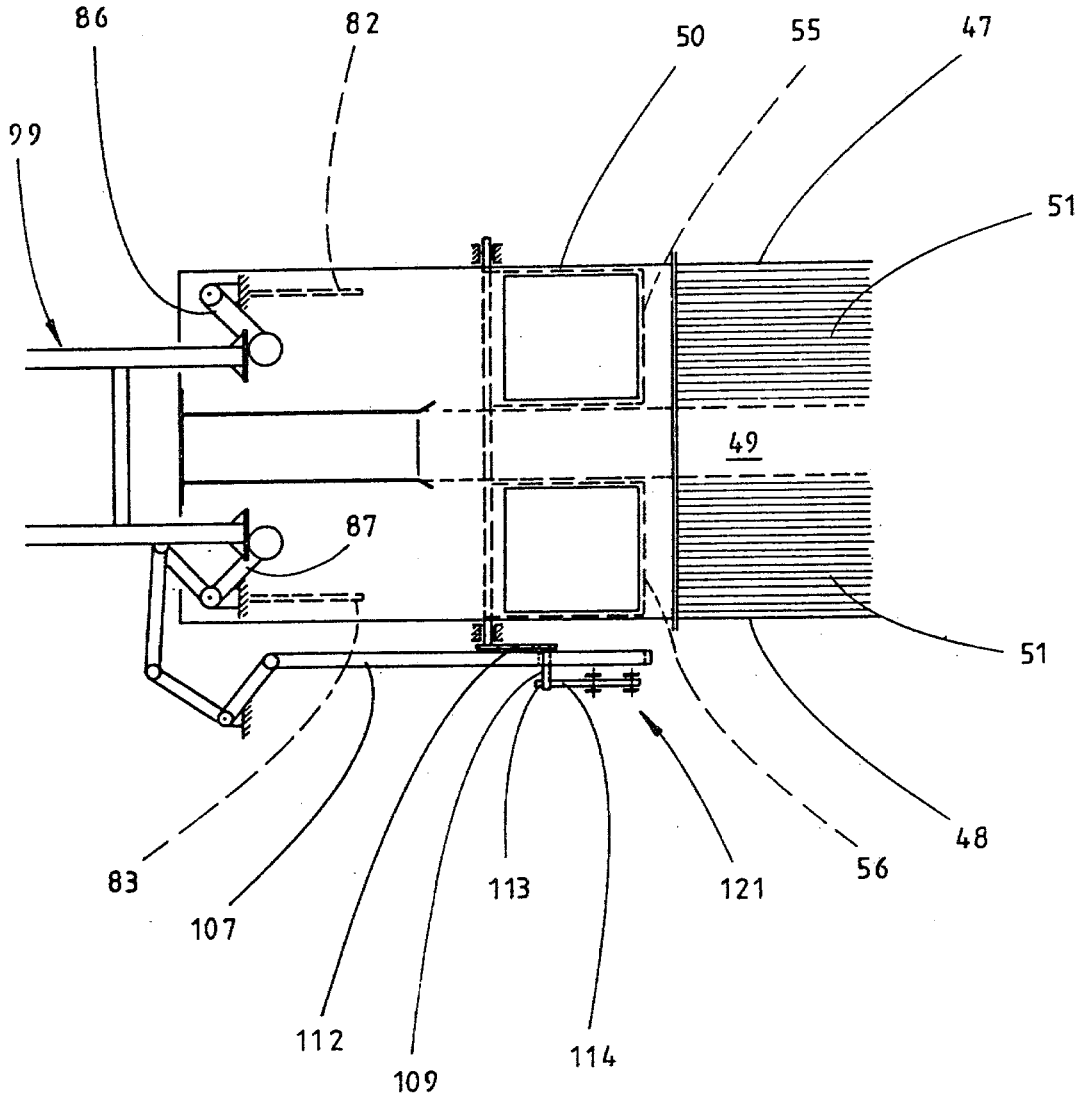
Figure 14:
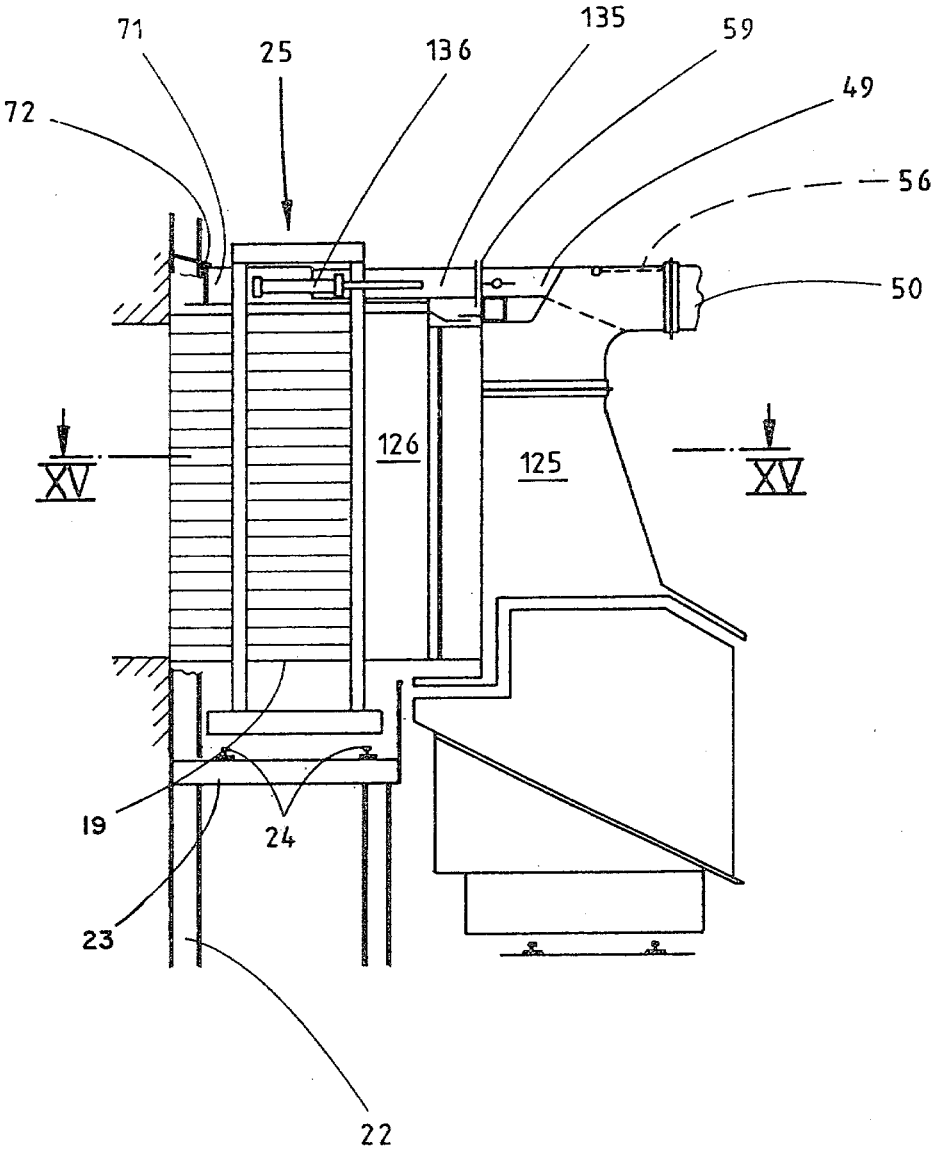
Figure 15:
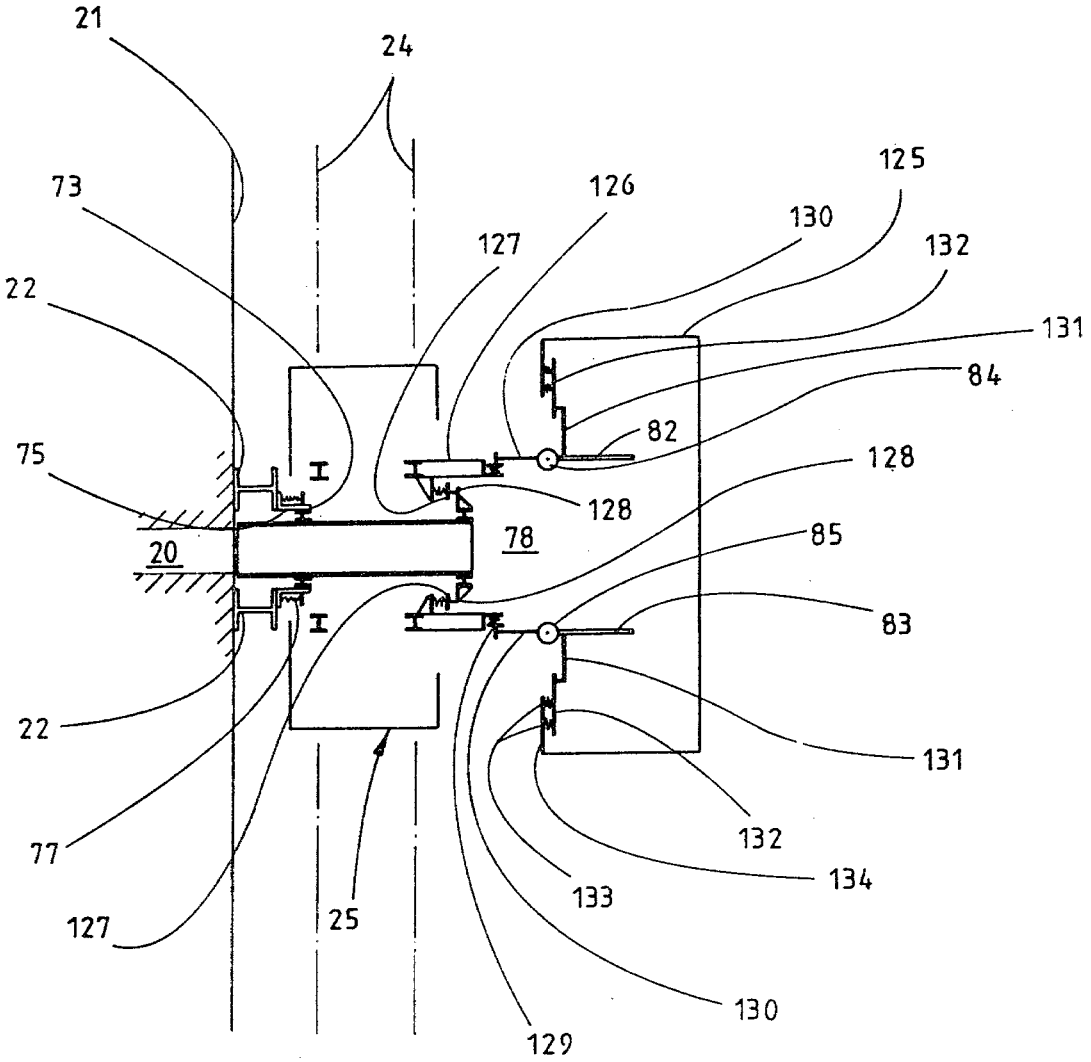

FIG. 8 shows the inlet opening of the connecting duct and the actuating device for closing it as well as shutters for the passage opening in the extraction hood in the closed position, in a front view, FIG. 9 shows the shutter in the connecting line in the open position, FIG. 10 shows an actuating device for the shutter in a gas outlet duct in a view along the arrow X, in the retracted position of the sealing frame, the gas outlet ducts being closed towards the gas extraction hood but being open towards the free atmosphere, FIG. 11 shows a plan view relating to FIG. 10, FIG. 12 shows the device according to FIG. 10, but in the operating position of the sealing frame, in which the gas outlet ducts are open towards the interior of the extraction hood but are closed towards the free atmosphere, FIG. 13 shows a plan view relating to FIG. 12, FIG. 14 shows another embodiment of the invention in a partially cut-away view similar to FIG. 1 and FIG. 15 shows a horizontal section along line XV—XV in FIG. 14.

FIG. 1 shows an oven chamber 20 of a battery 21 of chamber coke-ovens with vertical flue, the opening of the oven chamber being flanked by vertical oven stays 22. On a gas gallery 23 on the coke side, a coke guide car 25 is arranged so that it can travel on rails 24 parallel to the longitudinal axis of the coke-oven battery. The coke guide car has a cage 26 in which a coke guide 19 is fixed for serving to transfer a red-hot coke cake into a transport car 27 which can travel, likewise parallel to the coke-oven battery, on a track 28 laid at ground level. An undercarriage 29 (FIG. 2) bearing an extraction hood 30 is mounted on the side of the transport car facing away from the coke-oven battery, so that it can travel on a supporting structure 36 by means of wheels. The wheels include a first pair of wheels 31 on a rail 30 and a second pair of wheels 32 which are received in a lateral groove 35 opening towards the coke-oven battery in a slot rail 34. Pairs of wheels 144 in the zone of the track wheels 31 serve for lateral guiding of the undercarriage 29 in such a way that the track wheels 32 cannot touch the bottom of the rail slot 35.

At a small distance, the extraction hood covers the open top side of the box-like superstructure 37 of the transport car 27 and is connected gas-tight and rigidly to a gas transfer device 38 with a 90° elbow 39 located therein. The gas transfer device 38 is an integral component, that is to say, a component rigidly built in, of the hood undercarriage 29.

Figure 3:
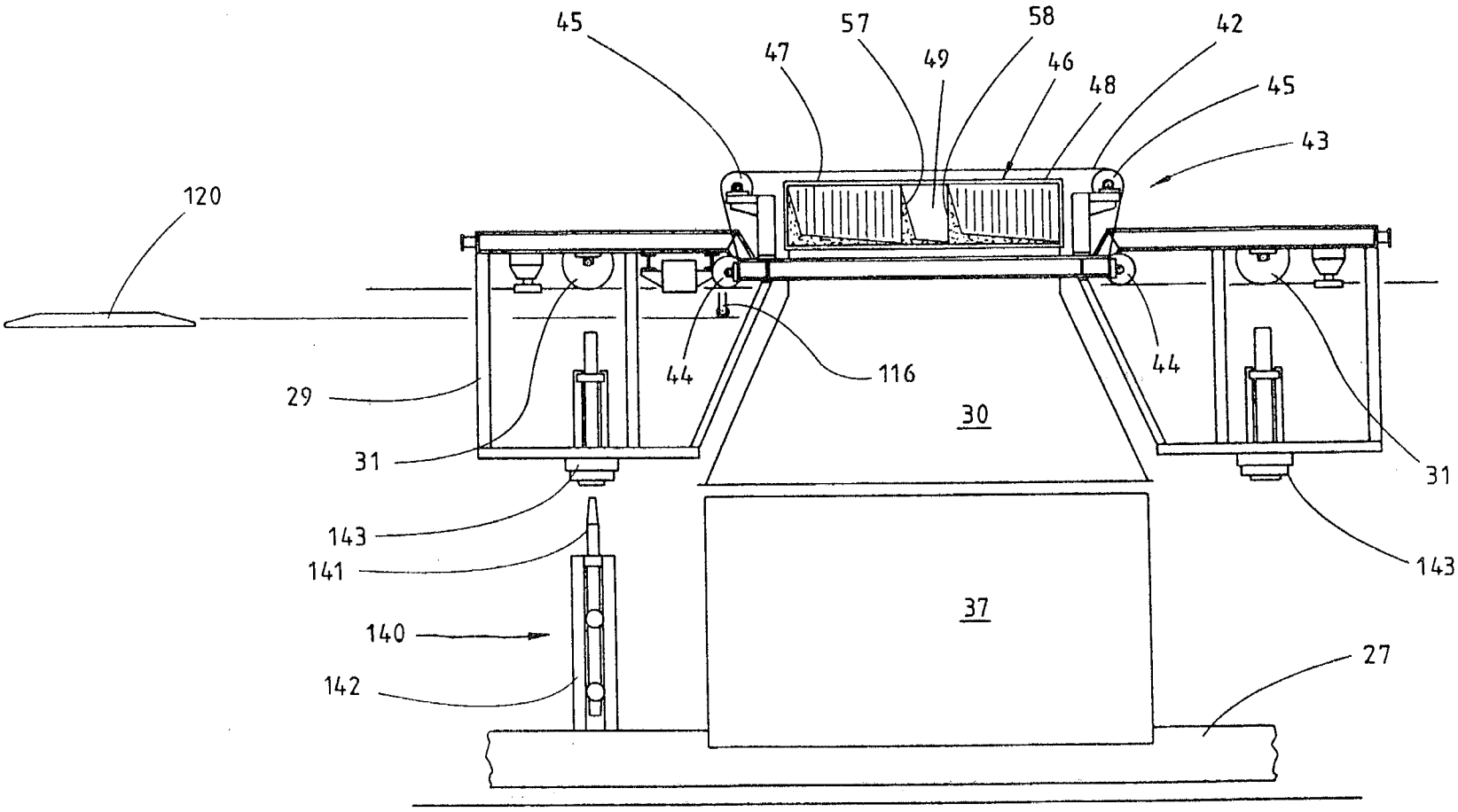
FIG. 3 shows a horizontal section along line III—III in FIG. 1.

Below the gas transfer device 38, a gas main duct 40 which is mounted in the supporting structure 36 and extends parallel to the coke-oven battery. The gas main duct has, on its top side, a longitudinally extending opening 41 which, as can be seen in FIG. 3, is normally closed by an elastic cover belt 42 manufactured from heat-resistant material. By means of a lifting-off device 43 associated with the gas transfer device 38, the cover belt can be lifted by means of a lower pair 44 of rollers and an upper pair 45 of rollers.

As best viewed in FIG. 3, one of the upper rollers 45 is at the back of the gas transfer device 38 and is offset forwardly of one of the lower rollers 44 at the back of the gas transfer device 38. Similarly, one of the upper rollers 45 is at the front of the gas transfer device 38 and is offset rearwardly of a lower roller 44 at the front of the device 38. The elastic cover belt 42 is thus stretched from the lower rollers 44 over the top of the 90° elbow 39 so as to permit the foul gases issuing from the 90° elbow to be extracted into the gas main duct 40 through the opening 41 by means of a suitable gas extraction and purification device (not illustrated) which is connected thereto.

According to FIGS. 2 and 3, the extraction hood 30 contains, below its top side 46, two gas outlet ducts 47, 48 which are each located on one side of a connecting line 49 in a horizontal plane and occupy the cross-section of the upper part of the extraction hood as FIG. 3 shows.

In the zone of the gas transfer device 38, both in the 90° elbow 39 and in a section 50 adjacent thereto and connected to the extraction hood 30, both of the gas outlet ducts 47 and 48 contain gas coolers 51 which preferably consist of grates. These gas coolers enable the foul gases, rising from red-hot coke on the transport car 37 through the extraction hood 30, to be cooled to a temperature which is not hazardous to the cover belt.

Upstream of the section 50, as viewed in the direction of flow of the hot gases which are to be extracted through the gas outlet ducts 47, 48, cooling air apertures 52, 53 (FIG. 2) are cut into the top side 46 (FIG. 3) of the extraction hood or of the gas outlet ducts 47, 48. Apertures 52 and 53 enable cooling air to be drawn in through the gas coolers 51, due to the suction pressure in the gas main duct 40, and in this way ensure a more intense cooling of the gas coolers until the next oven is operated.

In the zone of the front edge of the cooling air apertures 52, 53, as viewed in the direction of flow, flap-like shutters 55, 56 (FIGS. 1 and 13) are mounted to be pivotable about horizontal axes 54 (FIG. 1).

In the position shown in FIG. 1, the shutters 55 and 56 are generally horizontally oriented to close the cooling air apertures 52 and 53 and thus permit the flow of foul gases through the gas outlet ducts 47 and 48, respectively. On the other hand, when the shutters 55 and 56 are tilted downwardly, they close the gas outlet ducts 47 and 48, respectively, and thus open the cooling air apertures 52 and 53, respectively. The device for actuating the shutters 55 and 56 is described in more detail hereinafter.

The connecting line 49 is separated from the lateral gas outlet ducts 47, 48 by side walls 57, 58 (FIG. 3) and has a width which corresponds to approximately half the width of one of the gas outlet ducts 47, 48. On the other hand, the gas outlet ducts and the connecting line have the same height.

Thus, the connecting line 49 leads, like the gas outlet ducts 47, 48, in the form of the elbow 39 into the gas main duct 40 and emerges from the top side of the hood in front of the cooling air apertures 52, 53 and ends in a sealing connector 50 (FIGS. 1 and 2) which is located in the plane of a side wall 60, facing the coke-oven battery 21, of the extraction hood 30.

The flow path to the connecting line 49 extends in the direction from the coke-oven battery 21 in the zone or region of the coke guide 19 as a coaxial line section 61. Coaxial line section 61 is fixed to the ceiling frame 62. The ceiling frame 62 is horizontally movable back and forth in the longitudinal direction toward or away from the oven chamber 20 on pairs of track wheels 65 mounted to beams 63 and 64 that project from the frame 62 on either side of the coke guide 19. The pairs of track wheels 65 are received in U-shaped channels 66 and 67 on either side of the coke guide 19. The channels 66 and 67 are secured to the cage 26 of the coke guide.

The frame 26, and hence line section 61, is moved towards and away from the oven chamber 20 by means of drive mechanisms 68 and 69 on either side of the coke guide 19. Specifically, each drive mechanism 68 and 69 consists of a hydraulic cylinder piston unit. The cylinders of each unit are fixed to the cage 26 of the coke guide 19. The piston rods are pivotally connected to rods or lugs 70 projecting laterally from the ceiling frame 62.

Figure 2:
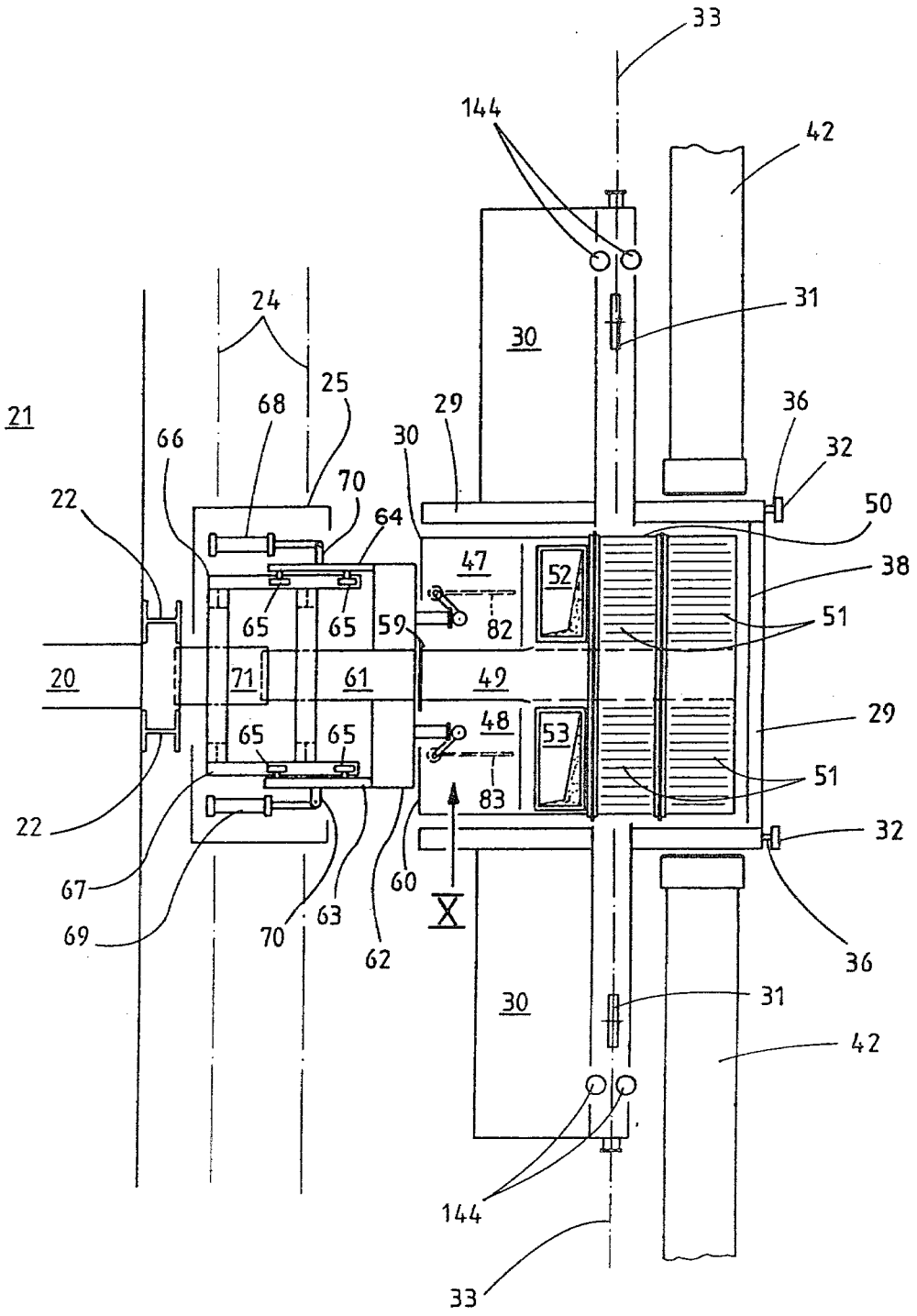
FIG. 2 shows a plan view of the equipment according to FIG. 1.

As FIGS. 1 and 2 show, the line section 61 telescopically engages in a line section 71 which is rigidly joined to the cage 26 of the coke guide and, together with the line section 61, forms a gas collection duct which reaches over the coke guide and which, when the red-hot coke cake is pushed out of the oven chamber 20 and forced through the coke guide, collects the hot foul gases rising therefrom so that these gases can be extracted through the connecting line 49 into the gas main duct 40. In the operating position of the coke guide 19, shown in FIG. 1, a baffle sheet 72 extends between the oven stays 22 in such a way that its front end reaches over the end face, opposite the oven chamber, of the line section 71 so that any gases issuing between the coke guide and the oven chamber opening into the space between the oven stays 22 are likewise received by the gas collection duct 61, 71 and passed on through the connecting line 49.

Figure 5:
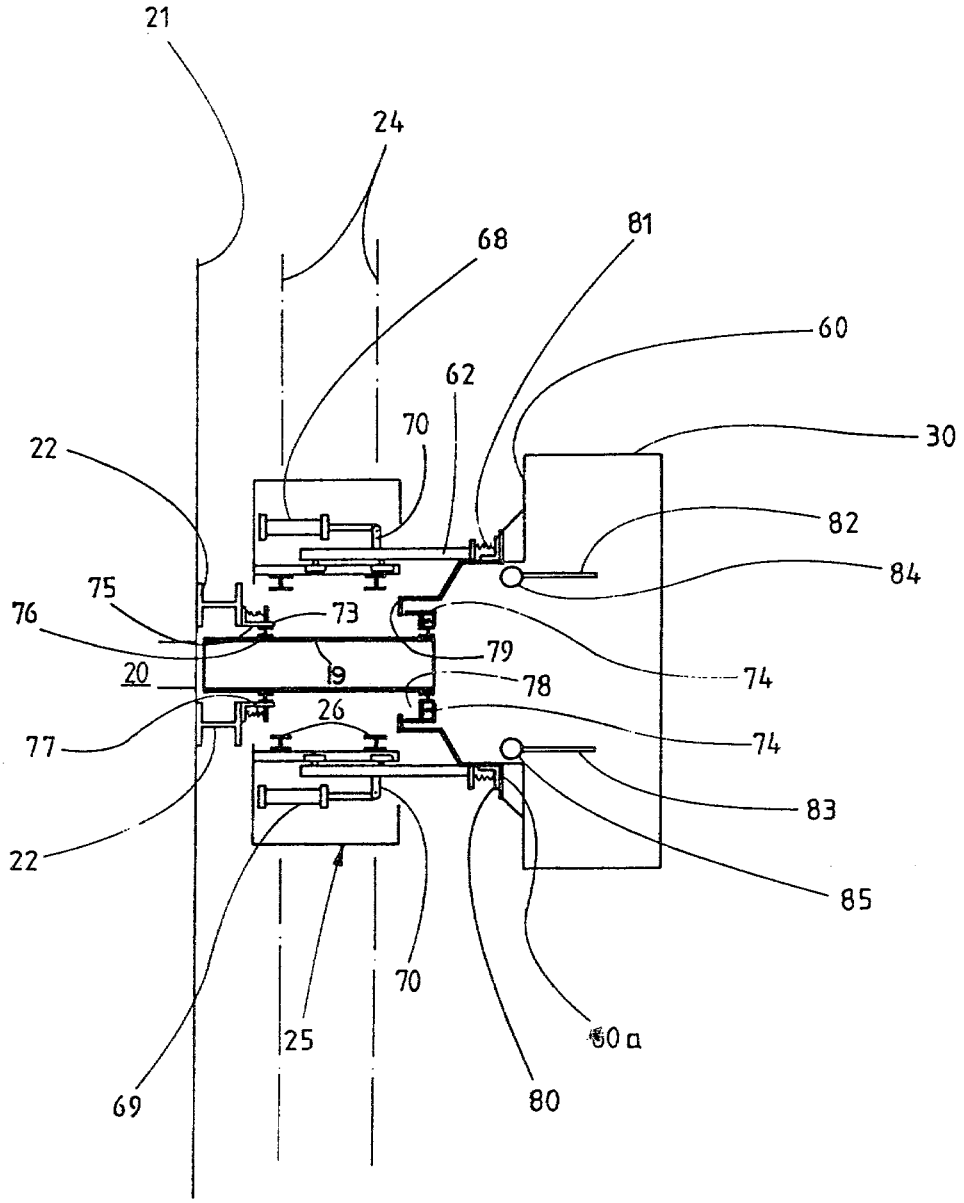
FIG. 5 shows a horizontal section along line V—V in FIG. 1.

As can be seen from FIG. 5, sealing strips 73 and 74 are provided in the zone of the end, facing the oven chamber 20 and the extraction hood 30 respectively, of the coke guide 19 on either side thereof. The sealing strips 73 are guided by means of sliding rods 75 in vertical T-profiles 76, the arms of which are fixed to the side wall of the coke guide and the webs of which form an abutment for sheet springs 77, the other end of which is supported on the sealing strips. The sealing strips 74 are designed in a similar manner, but in their operating position they bear against the inside of a rim 79 which surrounds a passage opening 78 of the extraction hood. Preferably, the sealing strips 74 are formed as a frame which completely and tightly encloses the sealing frame 62.

Sealing strips 80, designed in the same way as the sealing strips 73, 74, are located on the end face, opposite the extraction hood, of the sealing frame 62 in the form of a rectangular frame which, by means of spring elements 81, bears tightly under the action of the drive mechanisms 68, 69 against a sealing surface 60*a*, in the shape of a frame, of the side wall 60 of the hood. It can be seen that it is possible to achieve in this manner an almost complete sealing of the coke guide from the coke-oven battery 21 and from the extraction hood 30, the sealing frame 62 which surrounds the coke guide 19 ensuring a further sealing of the extraction hood from the outside.

Figure 4:
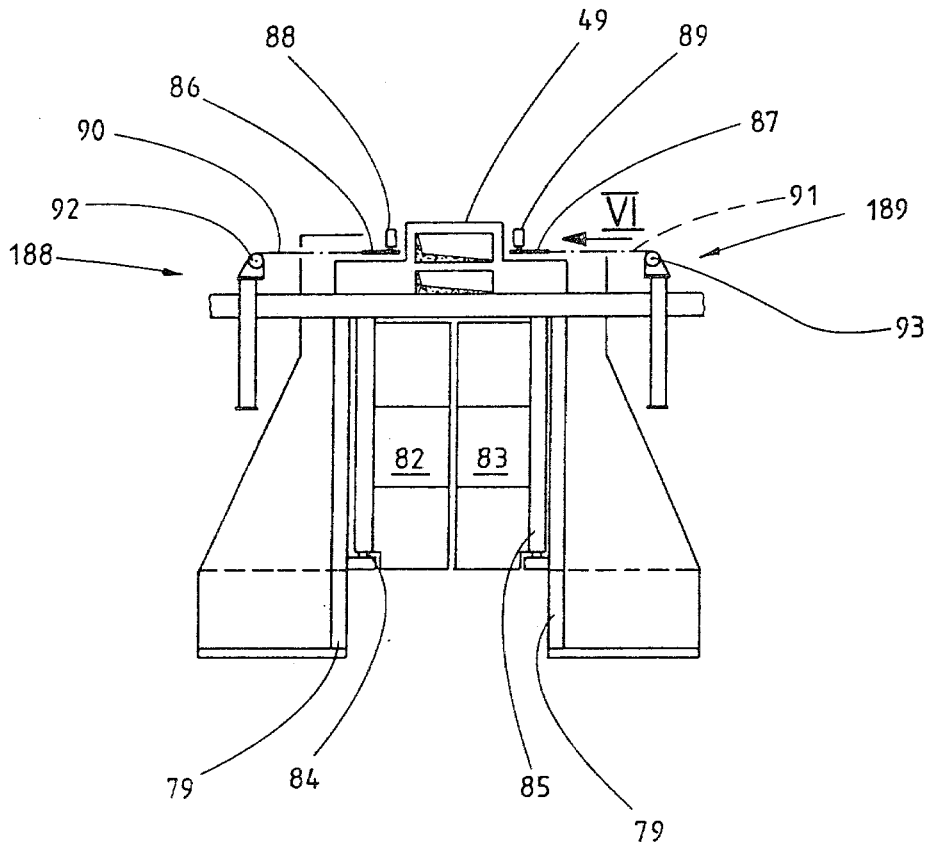
FIG. 4 shows a section along line IV—IV in FIG. 1.

The passage opening 78 of the extraction hood 30 is associated with two door-like shutters 82, 83 which are mounted to be pivotable about hinge pins 84, 85, respectively, on the sides of the passage opening which is widened in this zone. Contact levers 86 and 87 are radially mounted to the upper ends of the hinge pins 84 and 85, respectively. Rollers 88 and 89 are mounted to the ends of the levers 86 and 87, respectively, as best illustrated in FIG. 4. The contact levers 86 and 87 are connected to resetting devices 188 and 189, respectively, in such a way that each contact lever normally assumes the regular position illustrated in FIGS. 6 and 7 wherein they form an angle of about 90° to each other and project by about the diameter of the contact rollers (88 or 89) in the direction of the coke-oven battery, beyond the sealing connector 59 of the connecting line 49.

Preferably, the resetting devices 188 and 189 comprise the cable lines 90 and 91, respectively, which are fixed in a suitable manner to the contact levers 86 and 87, respectively. The cables 90 and 91 are guided over guide rollers 92 and 93, respectively, and are fastened to a suitable tension spring or to weights (not illustrated).

FIGS. 1 and 6 to 9 show that the connecting line 49 is also associated with a flap-like shutter 94 which is fixed on a shaft 95 extending horizontally through the side walls of the connecting line 49.

A lever 96 is mounted to one end of shaft 95 as best illustrated in FIGS. 6–9. A follower stem 97 is fixed to the distal end of lever 96 and is oriented substantially horizontally. Under the influence of gravity, the shutter 94 urges the follower stem 97 against a pin 98 which extends downwardly from a contact lever 87 to which the pin 98 is mounted.

Figure 6:
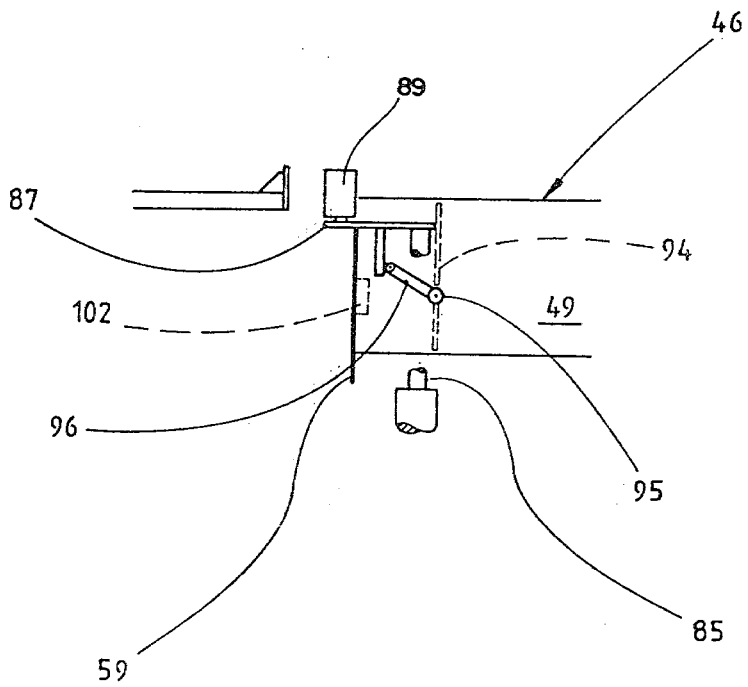
FIG. 6 shows a cut-away view in the direction of the arrow VI in FIG. 4.
Figure 7:
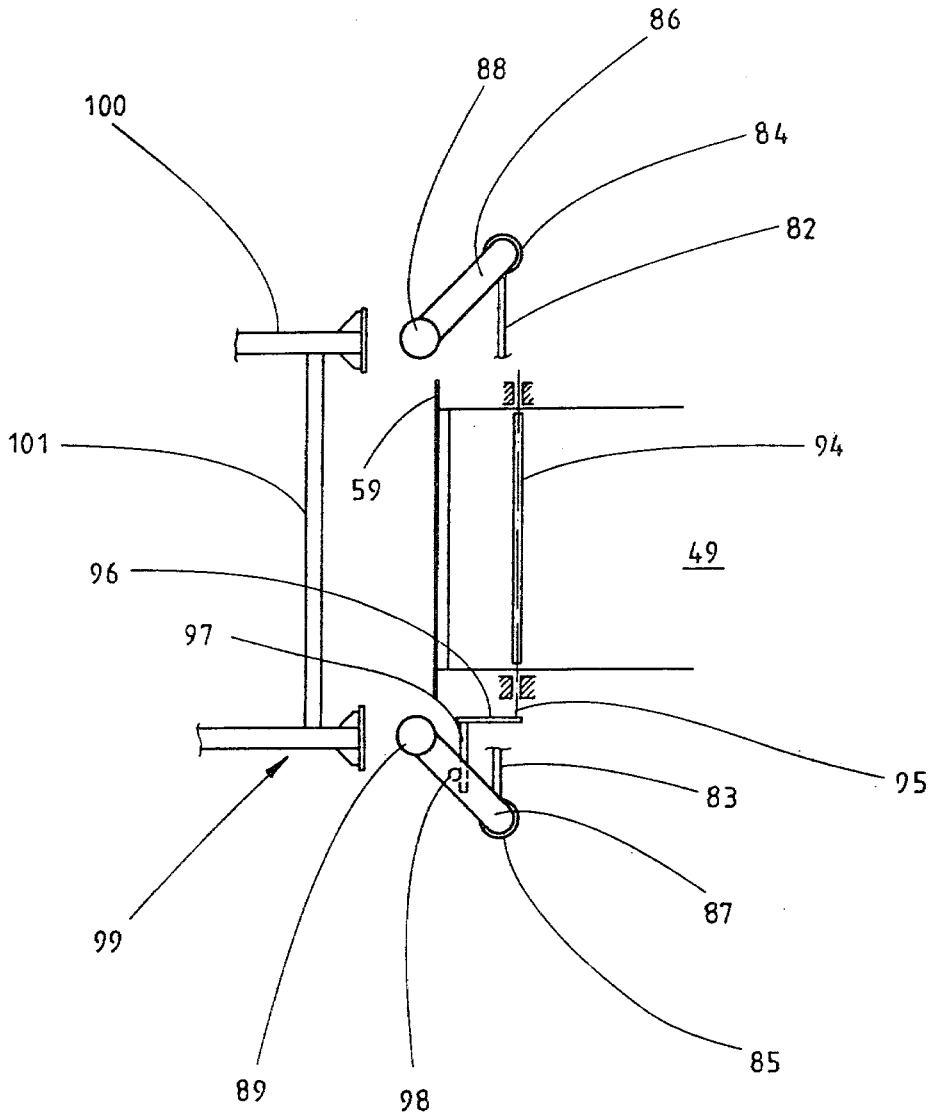
FIG. 7 shows a plan view relating to FIG. 6.

FIGS. 6 and 7 show an actuating device 99 for the contact levers 86, 87, which actuating device consists of two actuating arms 100 which are located at the height of the contact rollers 88, 89 and which are connected to one another by a tie 101. The actuating arms 100 project beyond the end face of the sealing frame 62 opposite the extraction 30 and serve to actuate the contact levers 86 and 87. FIGS. 6 and 7 show the actuating device 99 in the rest position in which the door-like shutters 82, 83 of the extraction hood 30 and the shutter 94 of the connecting line 49 are in the closed position. It can be seen, however, that the contact levers 86, 87 are pivotable against the action of the resetting devices 188, 189 connected thereto, clockwise or counterclockwise. As shown in FIG. 13, the door-like shutters 82 and 83 of the passage opening 78 in the extraction hood are open and the flap-like shutter 94 in the connecting line 49 assumes the horizontal open position shown in FIG. 9. In FIG. 9, a transversely extending protective web 102 is shown which extends transversely over the cross-section of the sealing line at the height of the shaft of the latter and at a distance from the front edge of the flap-like shutter 94. It can be seen that the connecting line 49 and the passage opening 78 in the side wall of the extraction hood are open only in the operating state of the equipment, but are closed when the sealing frame 62 is retracted. Consequently, the aspiration of air into the main duct is prevented, which air could adversely affect the quality of the distillation products. Moreover, the risk of corrosion on the inside of the ducts is reduced.

The actuating device for the flap-like shutters 55, 56, already mentioned above, in the gas outlet ducts 47, 48 can be seen from FIGS. 10 to 13. A lever 103 is connected to the hinge pin 85 at right angles to the contact lever 87, which lever 103 is pivotally joined via a connecting rod 104 to an angle lever 105 which is pivotable about a vertical axis at a fixed point 106 on the extraction hood and the other lever end of which is hinged to a control rod 107 which extends parallel to the gas outlet duct 48 at a distance and in the direction of the main duct 40 and is in the form of a fork 108 at its end. A coupling pin 109 is in mobile engagement in the slot of the fork, which coupling pin is fixed, horizontally projecting, to the outer end of a lever 112 which is fastened to the end, laterally projecting out of the gas outlet duct 48, of the horizontal axis 54. In FIGS. 10 and 11, the coupling pin 109 is on the bottom 110 of the slot so that the lever 112 is in the position shown in FIG. 10, in which the flap-like shutters 55, 56 in the gas outlet ducts 47, 48, respectively, assume the closed position in the gas outlet ducts, as shown in dashes.

FIGS. 12 and 13 illustrate the engagement of the actuating device 99 with the contact rollers 88 and 89 on the contact levers 86 and 87, respectively. In this position, the hinge pin 85 has moved the arrangement of levers 103, 104, 105, and 107 to the actuated position wherein the door-like shutters 82 and 83 of the extraction hood are opened along with the flap-like shutters 55 and 56 in the gas outlet ducts 47 and 48. Also, the cooling air apertures 52 and 53 in the gas outlet ducts 47 and 48, respectively, are simultaneously closed by the flap-like shutters 55 and 56, respectively.

When the lever 107 moves to the right (as illustrated in FIG. 5) to close the flaps 55 and 56 against the apertures 52 and 53, respectively, the lever 112 is pivoted in a counterclockwise direction (as viewed in FIG. 12). In this position, the lever 112 is moved into the cramp or latch 113 of a cramp lever 114 of a locking device 121 (FIGS. 11 and 12). The cramp lever 114 is pivotally mounted about a fulcrum 115 (FIG. 12) in a vertical plane and is hinged, at the end opposite the cramp 113, to a lifting rod 116. Lifting rod 116 is pivotally guided by a lateral guide lever 117 which is hinged to a fixed fulcrum 118. The lower end of the lifting rod 116 is provided with a contact roller 119 which interacts with a control cam 120 which is fitted to the supporting structure 36 in the zone of a quench station, which is not shown, in such a manner that, when the extraction hood travels past, the lifting rod 116 is lifted by the control cam and the cramp 113 at the other end of the cramp lever is thus lowered and the coupling pin 109 is hence released. Consequently, the coupling pin 109 moves in the fork slot 111 of the control rod 107 under the weight of the flap-like shutters 55, 56 into the rest position shown in FIGS. 10 and 11, in which the shutters 55, 56 close the gas outlet ducts 47, 48 and free the cooling air ducts 52, 53 for cooling the gas coolers 51. It can thus be seen that the shutters 55 and 56 in the gas outlet ducts 47 and 48, respectively, shutter 94 in the connecting line, and shutters 82 and 83 in the passage opening 78 for the red-hot coke in the extraction hood are all moved simultaneously and automatically into the open position when the sealing frame moves towards the extraction hood 30, but only the shutter 94 in the connecting line 49 and the door-like shutters 82 and 83 in the extraction hood 30 close automatically when the sealing frame retracts from the extraction hood. However, the shutters 55 and 56 in the gas outlet ducts 47 and 48 respectively are held in their open position by the locking device 121 until the control cam 120 actuates the locking device, so that the cramp lever 114 releases the coupling rod 109 and the shutters automatically assume the closed position according to FIGS. 10 and 11.

FIG. 3 shows a coupling device 140 which protrudes upwards from the transport car 27 and which is provided with a coupling pin 141 which can be moved up and down in a guide 142 by any desired drive mechanism which is not shown. A coupling socket 143 which serves to receive the coupling pin 141 is vertically fitted in the undercarriage 29 of the hood. A coupling socket of this type is provided on either side of the extraction hood 30. In the coupled state of the transport car 27 and of the hood undercarriage 29, the extraction hood 30 is located exactly above the load opening of the box-like superstructure 37 of the transport car 27 so that red-hot coke, while being transported by means of the transport car, is continually covered by the extraction hood 30. Since the shutters 55 and 56 of the gas outlet ducts 47 and 48, respectively, remain open until the control cam 120 actuates the locking device 121 when the transport car 27 reaches the quench station to close the shutters, the extraction through the extraction hood is effective as long as the extraction hood is coupled to the transport car.

A modified embodiment of the invention is shown in FIGS. 14 and 15, in which identical or similar parts are marked by the same reference numerals. The difference as compared with the first embodiment consists of the modified, approximately rectangular shape of the extraction hood 125 in plan and by the type of seal between the extraction hood and the sealing frame 126. According to FIG. 15, the sealing frame is provided on its inside with spring-loaded sealing strips 127 which act in the direction of the extraction hood, and angular sealing edges 128, which extend vertically on either side of the coke guide in the zone of the end of the latter facing the extraction hood. The sealing edges 128 bear against the faces of the sealing strips 127 opposite the extraction hood 125. On the side facing the extraction hood, the sealing frame is provided with spring sheet seals 129 which act towards both outer sides, and sealing rims of first sealing plates 130. The plates 130 are fitted, on the side opposite the door-like shutters 82, 83, on the hinge pins 84, 85 in the plane of these door-like shutters and bear against the spring sheet seals. Moreover, in the open position shown when the shutters 82 and 83 are in FIG. 15, second sealing plates 131 are provided in the zone of the hinge pins 84 and 85 to extend outwardly at right angles from the open shutters 82 and 83. The sealing plates 131, in the open position, bear against the inside of gasket sheets 132 which are each fitted tightly by means of two vertically extending spring sheets 133 to the inside of the side wall 134, delimiting the passage opening 78, of the extraction hood 125.

A further difference is that the connecting line portion 135, associated with the sealing frame 126, is adjustable on the sealing frame 126 by means of a hydraulic cylinder/piston unit 136 in the directions towards and away from the sealing connector 59 of the connecting line 49 in the extraction hood.

In yet a further modification of the embodiment described, a thermostat can be provided in the extraction hood. When the temperature of the foul gases in the extraction hood is hazardous for the cover belt which covers the gas main duct, the thermostat actuates a switch by means of which the locking device for the flap shutters in the gas outlet ducts is actuated so that the flaps close the gas outlet ducts and cooling air is drawn into the gas main duct. This emergency switching ensures that risks to operation as a result of destruction of the belt covering the gas main duct by excessively hot foul gases are eliminated.

We claim:

1. In equipment for collecting, extracting and purifying gases from the coke side of a battery of coke oven chambers with vertical flues and having a track which runs on the gas gallery along the oven chambers and on which a coke guide car can travel, the coke guide of which is adjustable on the coke guide car transversely to the direction of motion thereof in the longitudinal direction of the oven chambers;

a gas collection duct above and connected to the coke guide;

a transport car which can travel along the oven chambers;

an extraction hood which reaches over the loading zone of the transport car, which can travel along the oven chambers, which is provided with a lateral passage opening sealable from the coke guide, and which is adapted to be connected to the gas collection duct when the fully carbonized coke cake is pushed into the transport car;

a stationary gas extraction and purification device;

a gas main duct arranged parallel to the battery of coke oven chambers and connected to the gas extraction and purification device, the gas main duct having a longitudinally extending opening covered by an elastic cover belt which can be lifted off the opening of the gas main duct; and a gas transfer device which is connected to the gas collection duct and extraction hood and which is movable above the gas main duct and below the cover belt for the purpose of lifting the latter off the opening of the gas main duct so that the gas can be transferred from the gas collection duct and the extraction hood into the gas main duct, the improvement comprising:

an undercarriage supporting the extraction hood, said gas transfer device being rigidly built into said undercarriage;

a connection line integral with the extraction hood and connecting the gas collection duct above the coke guide to the gas transfer device;

gas outlet ducts that are also integral with the extraction hood, but separate from the connecting line, for connecting the interior of the extraction hood to the gas transfer device, said gas transfer device being joined rigidly and gas-tight to the connecting line and to the gas outlet ducts of the extraction hood so that, in the operating position of the equipment, the foul gases collected above the coke guide can be transferred into the gas main duct separately from the foul gases which rise from the transport car into the extraction hood;

shutters provided in each of the gas outlet ducts and in the connecting line, said shutters being operable in their respective gas outlet ducts and connecting line between a closed position blocking the flow of foul gases and an open position permitting the flow of foul gases into said gas transfer device;

said coke guide being at least partially surrounded by a sealing frame which is of telescopic design and can be moved toward and away from the extraction hood parallel to the main axis of the coke guide;

a drive mechanism for moving the sealing frame;

means for opening the shutters in the gas outlet ducts and in the connecting line when the sealing frame moves towards the extraction hood; and gas coolers provided in the zone of the gas transfer device downstream of the gas outlet duct shutters.

2. Equipment as claimed in claim 1 wherein there are two gas outlet ducts, each with an aperture to the ambient atmosphere for permitting the intake of cooling air; wherein the shutters for the two gas outlet ducts can be fixed in their open position by a locking device and can be released only by a stationary control device; wherein the gas outlet duct shutters, in their positions in which they open the gas outlet ducts, simultaneously close said cooling air apertures; and wherein the gas outlet duct shutters open said cooling air apertures when the gas outlet duct shutters close said gas outlet ducts to enable cooling air to be supplied to the gas coolers.

3. In equipment for collecting, extracting and purifying gases from the coke side of a battery of coke oven chambers with vertical flues and having a track which runs on the gas gallery along the oven chambers and on which a coke guide car can travel, the coke guide of which is adjustable on the coke guide car transversely to the direction of motion thereof in the longitudinal direction of the oven chambers;

a gas collection duct above and connected to the coke guide;

a transport car which can travel along the oven chambers;

an extraction hood which reaches over the loading zone of the transport car, which can travel along the oven chambers, which is provided with a lateral passage opening sealable from the coke guide, and which is adapted to be connected to the gas collection duct when the fully carbonized coke cake is pushed into the transport car;

a stationary gas extraction and purification device;

a gas main duct arranged parallel to the battery of coke oven chambers and connected to the gas extraction and purification device, the gas main duct having a longitudinally extending opening covered by an elastic cover belt which can be lifted off the opening of the gas main duct; and a gas transfer device which is connected to the gas extraction duct and extraction hood and which is movable above the gas main duct and below the cover belt for the purpose of lifting the latter off the opening of the gas main duct so that the gas can be transferred from the gas collection duct and the extraction hood into the gas main duct, the improvement comprising:

an undercarriage supporting the extraction hood, said gas transfer device being rigidly built into said undercarriage;

a connection line integral with the extraction hood and connecting the gas collection duct above the coke guide to the gas transfer device;

a gas outlet duct integral with the extraction hood, but separate from the connecting line, for connecting the extraction hood to the gas transfer device, said gas transfer device being joined rigidly and gas-tight to the connecting line and to the gas outlet ducts of the extraction hood so that, in the operating position of the equipment, the foul gases collected above the coke guide can be transferred into the gas main duct separately from the foul gases which rise from the transport car into the extraction hood; and gas cooling grates disposed within said gas outlet duct and adapted to be heated by said foul gases and subsequently cooled by cooler air admitted to said gas oulet duct.

* * * * *

UNITED STATES PATENT OFFICE
CERTIFICATE OF CORRECTION

Patent No. 4,312,713 Dated January 26, 1982

Inventor(s) Georg Mayer, Hans Schroter, Helmut Laux

It is certified that error appears in the above-identified patent and that said Letters Patent are hereby corrected as shown below:

Column 5, line 47: "50" should be --59--.

Column 9, line 24: Delete "in the open position shown".

Column 9, line 25: Insert --in the open position shown" after "are".

Signed and Sealed this

*Fifteenth* Day of *June 1982*

[SEAL]

*Attest:*

GERALD J. MOSSINGHOFF

*Attesting Officer* *Commissioner of Patents and Trademarks*